US011008665B2

(12) United States Patent
Dow et al.

(10) Patent No.: US 11,008,665 B2
(45) Date of Patent: May 18, 2021

(54) METHOD FOR MANUFACTURING COPPER FOIL WITH ROUGH SURFACE IN PLATING TANK AND ITS PRODUCT

(71) Applicant: NATIONAL CHUNG HSING UNIVERSITY, Taichung (TW)

(72) Inventors: Wei-Ping Dow, Taichung (TW); Liang-Jie Lin, Taichung (TW); Chia-Hsiang Chen, Taichung (TW)

(73) Assignee: NATIONAL CHUNG HSING UNIVERSITY, Taichung (TW)

( * ) Notice: Subject to any disclaimer, the term of this patent is extended or adjusted under 35 U.S.C. 154(b) by 89 days.

(21) Appl. No.: 16/427,118

(22) Filed: May 30, 2019

(65) Prior Publication Data

US 2019/0376198 A1 Dec. 12, 2019

(30) Foreign Application Priority Data

Jun. 7, 2018 (TW) ..... 107119716

(51) Int. Cl.
*B21C 37/00* (2006.01)
*C25D 1/04* (2006.01)

(52) U.S. Cl.
CPC ..... *C25D 1/04* (2013.01); *Y10T 428/12431* (2015.01); *Y10T 428/12993* (2015.01)

(58) Field of Classification Search
None
See application file for complete search history.

(56) References Cited

U.S. PATENT DOCUMENTS 5,421,985 A * 6/1995 Clouser ..... C25D 3/38 205/77
2011/0127074 A1 6/2011 Takahashi

FOREIGN PATENT DOCUMENTS

WO 2013/047272 A1 4/2013
WO WO-2015040991 A1 * 3/2015 ..... B60C 1/0016

* cited by examiner

*Primary Examiner* — Seth Dumbris
(74) *Attorney, Agent, or Firm* — Pai Patent & Trademark Law Firm; Chao-Chang David Pai

(57) ABSTRACT

A method for manufacturing a copper foil with a rough surface in a plating tank includes causing an electrolyte solution to flow between an anode and a cathode with a current density of 5 ASF-40 ASF. The copper foil with a rough surface including dense nodules of single copper crystals is deposited on the cathode. The electrolyte solution includes chloride ions (20 ppm-80 ppm), polyethylene glycol (PEG) with a molecular weight of 400-8000 (100 ppm-700 ppm), sulfuric acid (20 g/L-200 g/L), copper sulfate pentahydrate (70 g/L-320 g/L) and a sulfur compound (1 ppm-60 ppm).

3 Claims, 12 Drawing Sheets

METHOD FOR MANUFACTURING COPPER FOIL WITH ROUGH SURFACE IN PLATING TANK AND ITS PRODUCT

BACKGROUND OF THE INVENTION

1. Field of the Invention

The present invention relates to a method for manufacturing a copper foil with a rough surface in a plating tank. The rough surface includes nodules of single copper crystals. The copper foil can be applied to packaging process of IC, printed circuit boards (PCB), flexible printed circuit boards (FPCBs), cathodes of lithium batteries, heat sinks, etc.

2. Description of the Related Art

Traditionally, raw copper foils are formed by electro-depositing copper ions of an electrolyte solution on a rotary cylindrical cathode. The side of a copper foil attaching to the cathode is called the shiny side and the other side is the matte side. The matte side is further roughened through an electro-deposition process to form a layer of copper nodules (i.e., a roughened layer) so that the surface area is increased and the foil can be well adhered to the insulating resin substrate. After the roughening process, the loose copper nodules have to be fixed on the raw foil by depositing a layer of dense copper there between. At last, a barrier layer of single metal or alloy is formed on the fixed copper nodules to improve its properties of anti-oxidation, corrosion resistance, ion migration resistance and heat resistance.

TWI434965 (U.S. 20110127074) disclosed a method for roughening the matte side of a copper foil, in which fine copper particles are deposited on the matte side of the copper foil, and a sulfuric acid-based copper plating solution containing a quaternary ammonium salt polymer is employed.

TWI605735 (WO2013047272A1) disclosed a roughening process for forming particles on the matte side of an electrolytic copper foil having a thickness of 12 μm. The reaction solution includes Cu (15 g/L), $H_2SO_4$ (100 g/L), W (3 mg/L, added with sodium tungstate dihydrate) and sodium decyl sulfate (4 mg/L). The temperature is controlled at 38° C. and the current density is 54 A/dm$^2$.

Obviously, it's inefficient to produce the raw foils and roughen the surfaces in two plating tanks respectively containing different electrolyte solutions. The present invention therefore provides a novel method to save the processing time and cost by achieving the copper foils with a rough surface in one plating tank.

SUMMARY OF THE INVENTION

An object of the present invention is to provide a method for manufacturing a copper foil with a rough surface in one plating tank so as to save the processing time and cost.

The method includes a step of causing an electrolyte solution to flow between a cathode and an anode in a plating tank with a current density of 5 ASF-40 ASF to form a copper foil on the cathode. The copper foil has a rough surface not contacting the cathode. The rough surface includes nodules of single copper crystals and has an arithmetic mean roughness (Ra) of 0.20 μm-1.5 μm and a ten-point mean roughness (Rz) of 0.5 μm-8.0 μm.

The electrolyte solution in the plating tank includes chloride ions (20 ppm-80 ppm), polyethylene glycol (PEG) having a molecular weight of 400-8000 (100 ppm-700 ppm), sulfuric acid (20 g/L-200 g/L), copper sulfate pentahydrate (70 g/L-320 g/L) and a sulfur compound (1 ppm-60 ppm). The sulfur compound has the formula (1), $$R_1—S—C_nH_{2n}—R_2 \quad (1),$$

wherein $R_1$ is —H, —$C_7H_4NS$, —$CH_4N_2$, —S—$C_nH_{2n}$—$R_2$ or —$C_nH_{2n}$—$R_2$, $R_2$ is —$SO_3^-$, —$PO_4^-$ or —$COO^-$, and n is an integer from 2 to 10.

The above sulfur compound is preferably selected from the group consisting of 3-mercaptopropanesulfonate (MPS), bis-(3-sulfopropyl)-disulfide (SPS), 3-(2-benzthiazolylthio)-1-propanesulfonate (ZPS), 3-(N,N-dimethylthiocarbamoyl)-thiopropanesulfonate (DPS), (o-ethyldithiocarbonato)-s-(3-sulfopropyl)-ester (OPX), 3-[(amino-iminomethyl)thio]-1-propanesulfonate (UPS) and 3,3-thiobis(1-propanesulfonate) (TBPS).

The copper foil excluding the copper nodules preferably has a thickness of 2.5 μm-5 μm.

In one preferred embodiment, the above electrolyte solution includes chloride ions (30 ppm-60 ppm), polyethylene glycol (PEG) having a molecular weight of 400-5000 (100 ppm-700 ppm), sulfuric acid (20 g/L-200 g/L), copper sulfate pentahydrate (70 g/L-250 g/L) and a sulfur compound (1 ppm-15 ppm). The nodules are in the form of stepped cones and the matte side has a ten-point mean roughness (Rz) of 3.0 μm-7.0 μm.

In another preferred embodiment, the above electrolyte solution includes chloride ions (50 ppm-80 ppm), polyethylene glycol (PEG) having a molecular weight of 4000-8000 (100 ppm-700 ppm), sulfuric acid (20 g/L-200 g/L), copper sulfate pentahydrate (70 g/L-250 g/L) and a sulfur compound (15 ppm-60 ppm). The nodules are in the form of eggs and the matte side has a ten-point mean roughness (Rz) of 1.0 μm-3.0 μm.

In another preferred embodiment, the above electrolyte solution includes chloride ions (60 ppm-80 ppm), polyethylene glycol (PEG) having a molecular weight of 4000-8000 (100 ppm-700 ppm), sulfuric acid (20 g/L-200 g/L), copper sulfate pentahydrate (70 g/L-250 g/L) and a sulfur compound (40 ppm-60 ppm). The nodules are in the form of grains and the matte side has a ten-point mean roughness (Rz) of 0.6 μm-4.0 μm.

Preferably, one plating tank is used in the above method and the copper foil with a rough surface can be achieved through the electro-deposition process continuously or in batch. For example, the roll-to-roll (R2R) process is suitable for the flexible copper foils.

The copper nodules have a single crystal structure and thus perform lower electrical resistance.

By changing components of the electrolyte solution, the shapes and sizes of the copper nodules can be controlled according to requirements of the industries.

The rough surfaces including the copper nodules of different shapes have different roughness and can be adhered with insulating resin substrates.

The copper nodules of this invention are integrally formed with the copper foil and therefore more stable than the traditional structure composed by two layers, i.e., the raw copper foil and the roughed surface.

Since the dense nodules of single copper crystals with specific appearances and sizes are integrally formed on the surface of the copper foil, the traditional roughing process and fixing treatment are not necessary any more. The barrier layer can be directly formed on the raw copper foil.

The copper foils are usually classified into thick foils (>70 μm), normal foils (18 μm-70 μm), thin foils (12 μm-18 μm) and ultra thin foils (<12 μm). In the present invention, the raw copper foil has a thickness of 2.5 μm-5 μm excluding copper nodules and a surface roughness Ra of 0.20 μm-1.5 μm and Rz of 0.50 μm-8.00 μm, which are much lower than the threshold of the ultra thin foils. That is, the copper foil of this invention can be applied to packaging process of IC, printed circuit boards (PCBs), flexible printed circuits boards (FPCBs), cathodes of lithium batteries, heat sinks, etc.

DETAILED DESCRIPTION OF THE PREFERRED EMBODIMENTS

Figure 1:
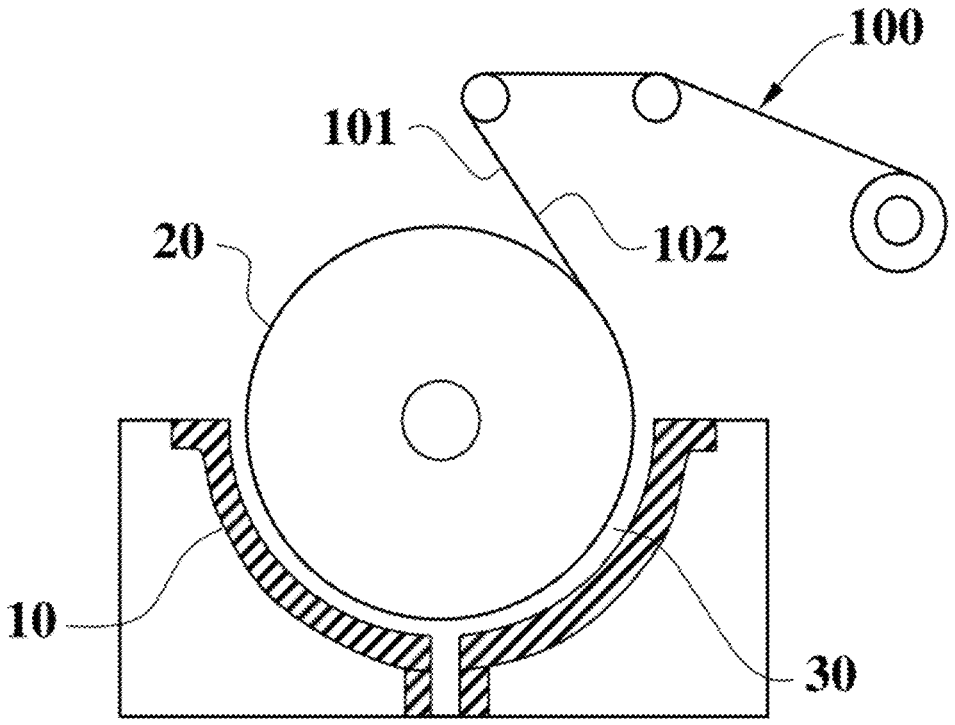
FIG. 1 illustrates a plating tank for manufacturing the electro-deposited copper foil.

FIG. 1 illustrates a plating tank for manufacturing the electro-depositing copper foil of the present invention, which includes a rotatable cylindrical cathode 20, an anode 10 and an electrolyte solution 30. The cathode 20 is made of titanium, or a polyimide film with a layer of nickel or cobalt film. The anode 10 can be soluble, usually being phosphorus-doped copper or insoluble, usually being platinum, $IrO_2$/Ti or $Ta_2O_5$/$IrO_2$/Ti. The electrolyte solution 30 flows between the cathode 20 and the anode 10, and a current passes through the anode 10 and the cathode 20. Metal copper is then deposited on the cathode 20 and then separated from the rotating cathode 20 to form a copper foil 100.

Operating conditions and components of the electrolyte solution 30 are as follows:

current density: 5 ASF-40 ASF;

temperature: 20° C.-25° C.;

chloride ions: 20 ppm-80 ppm;

polyethylene glycol (PEG, the preferred wetting agent, having a molecular weight of 400-8000): 100 ppm-700 ppm;

sulfuric acid: 20 g/L-200 g/L;

copper sulfate pentahydrate: 70 g/L-320 g/L; and a sulfur compound having the formula (1): 1 ppm-60 ppm, $$R_1—S—C_nH_{2n}—R_2 \quad (1),$$

wherein $R_1$ is —H, —$C_7H_4NS$, —$CH_4N_2$, —S—$C_nH_{2n}$—$R_2$ or —$C_nH_{2n}$—$R_2$, $R_2$ is —$SO_3^-$, —$PO_4^-$ or —$COO^-$, and n is an integer of 2-10.

According to the formula (1), the preferred sulfur compound is selected from the group consisting of 3-mercaptopropanesulfonate (MPS), bis-(3-sulfopropyl)-disulfide (SPS), 3-(2-benzthiazolylthio)-1-propanesulfonate (ZPS), 3-(N,N-dimethylthiocarbamoyl)-thiopropanesulfonate (DPS), (o-ethyldithiocarbonato)-s-(3-sulfopropyl)-ester (OPX), 3-[(amino-iminomethyl)thio]-1-propanesulfonate (UPS) and 3,3-thiobis(1-propanesulfonate) (TBPS).

Through the process with the above plating tank, conditions and the electrolyte solution, a raw copper foil having a thickness of 3 μm-5 μm is formed on the cathode. As shown in FIG. 1, the foil includes a shiny side 101 close to the rotary cathode and a matte side 102 on the reverse side. The matte side is roughed and includes dense nodules of single copper crystals. The matte side has an arithmetic mean roughness (Ra) of 0.20 μm-1.5 μm and a ten-point mean roughness (Rz) of 0.5 μm-8.0 μm, which can be controlled by changing the electrolyte solution.

Example 1

The electrolyte solution includes chloride ions (30 ppm-60 ppm), polyethylene glycol (PEG) having a molecular weight of 400-5000 (100 ppm-700 ppm), sulfuric acid (20 g/L-200 g/L), copper sulfate pentahydrate (70 g/L-250 g/L) and a sulfur compound (1 ppm-15 ppm).

Figure 2A:
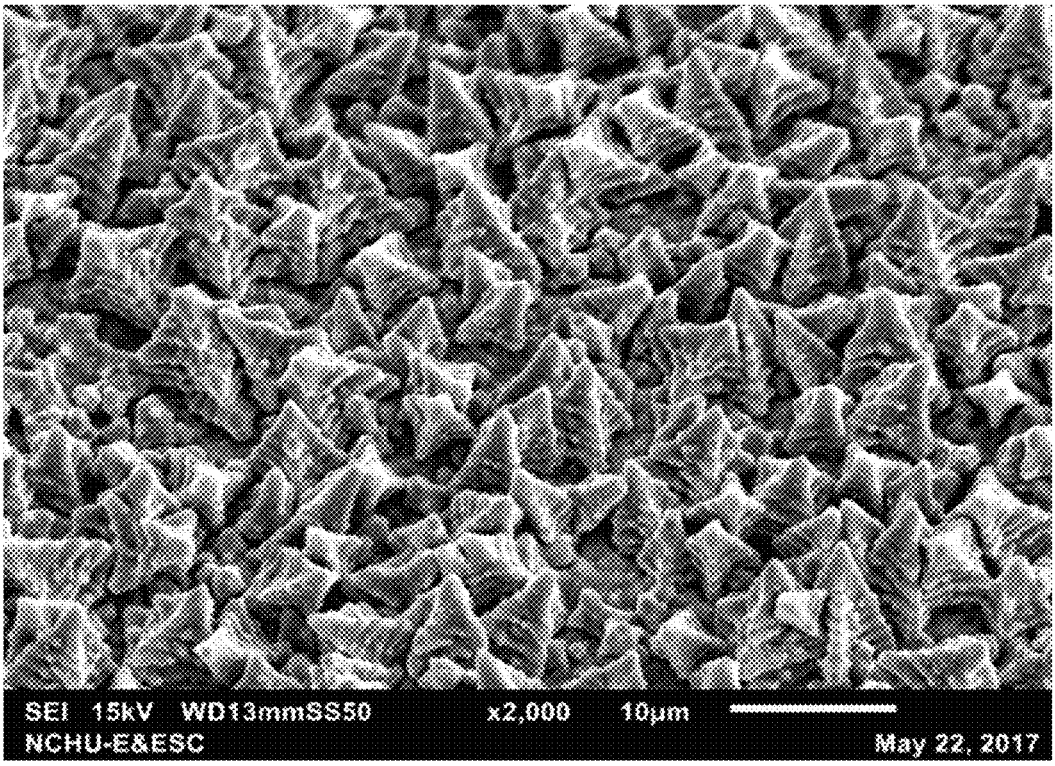
FIG. 2A shows the SEM image (2000×) of the rough surface on the matte side of the raw copper foil.
Figure 2B:
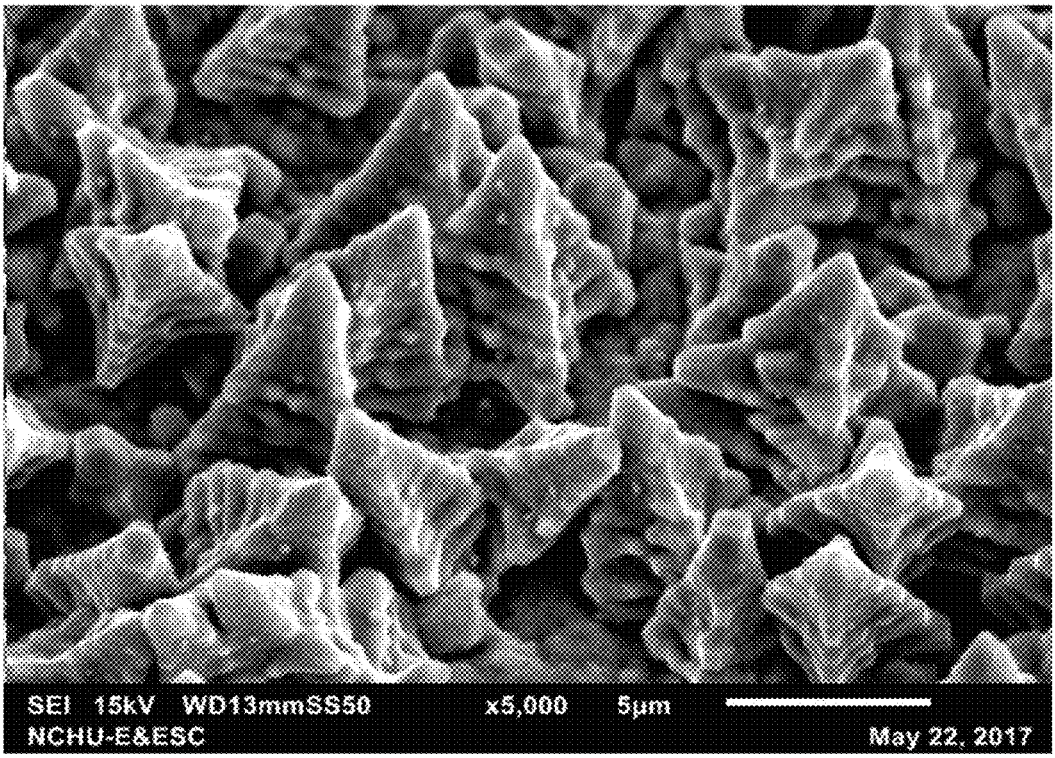
FIG. 2B shows the SEM image (5000×) of the stepped-cone-like copper nodules.

FIG. 2A and FIG. 2B show the scanning electron microscope (SEM) images (respectively at 2000× and 5000×) of the rough surface on the matte side of the raw copper foil. The copper nodules in the form of stepped cones are densely distributed on the surface. A ten-point mean roughness (Rz) of 3.0 μm-7.0 μm is measured.

Figure 2C:
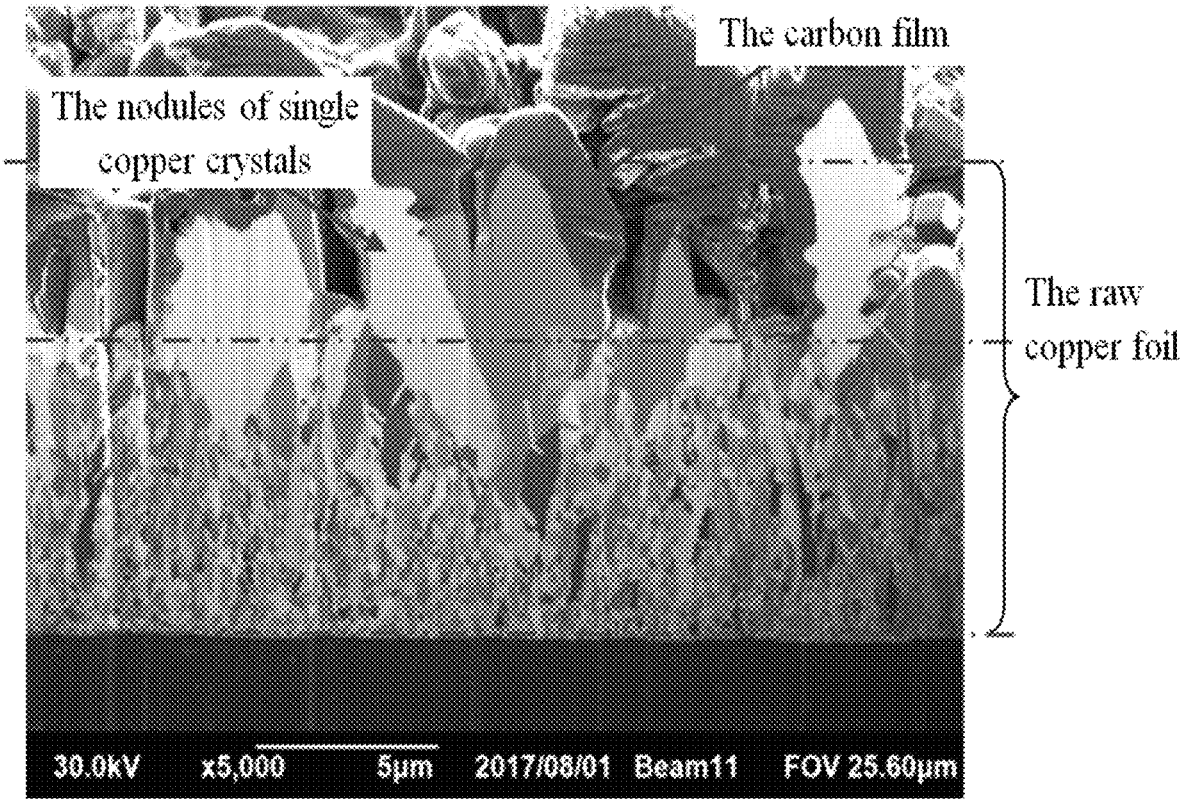
FIG. 2C shows the FIB image (5000×) of the stepped-cone-like copper nodules of Example 1.

FIG. 2C shows the focused ions beam (FIB) image (5000×) of the stepped-cone-like copper nodules.

Figure 3:
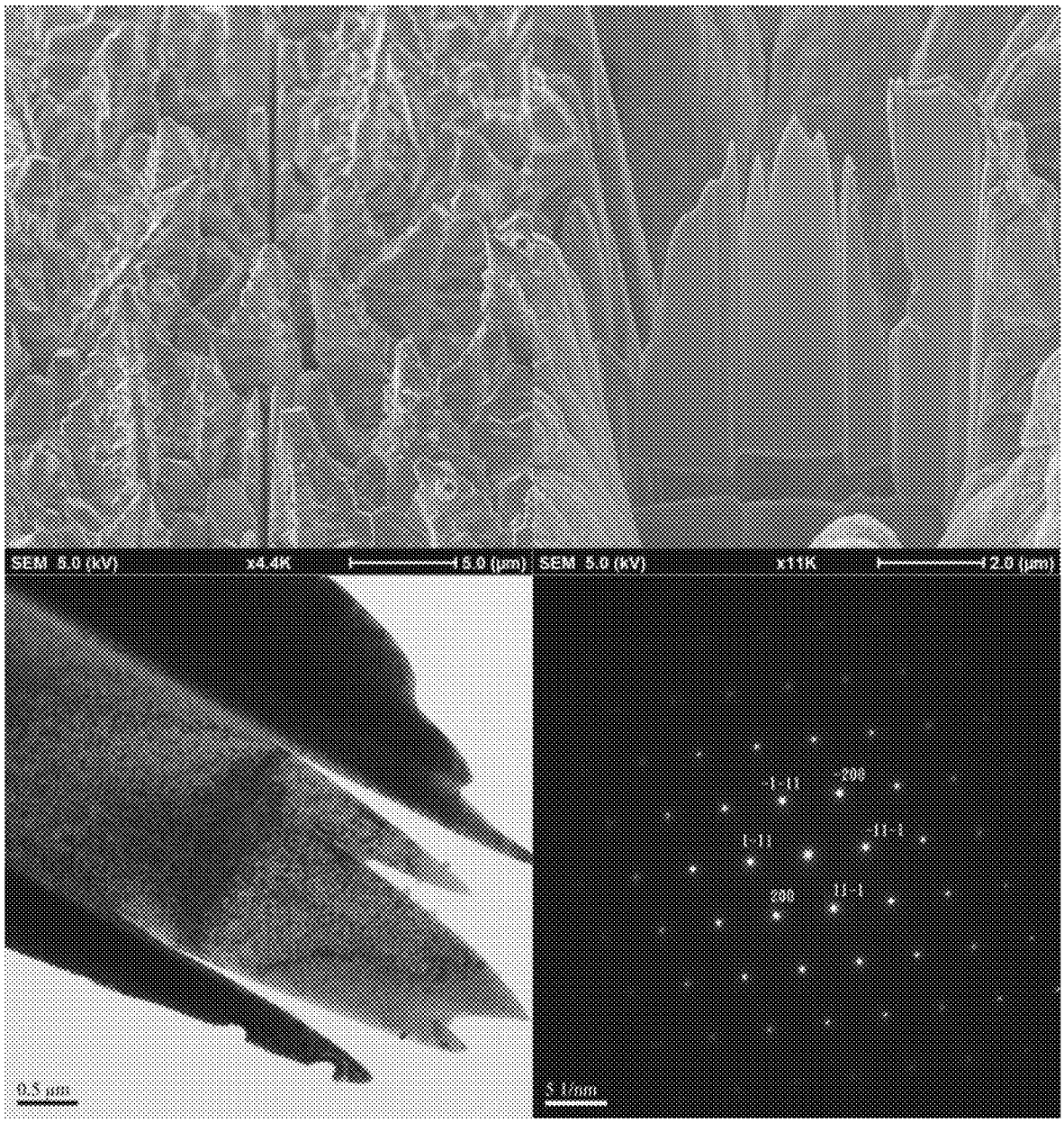
FIG. 3 shows the TEM & electron diffraction analysis of the stepped-cone-like copper nodules of Example 1.

FIG. 3 shows the SEM images (upper) and the transmission electron microscope (TEM) & electron diffraction analysis (lower) of the stepped-cone-like copper nodules, which can verify that these nodules have the structure of single crystals.

Example 2

The electrolyte solution includes chloride ions (50 ppm-80 ppm), polyethylene glycol (PEG) having a molecular weight of 4000-8000 (100 ppm-700 ppm), sulfuric acid (20 g/L-200 g/L), copper sulfate pentahydrate (70 g/L-250 g/L) and a sulfur compound (15 ppm-60 ppm).

Figure 4A:
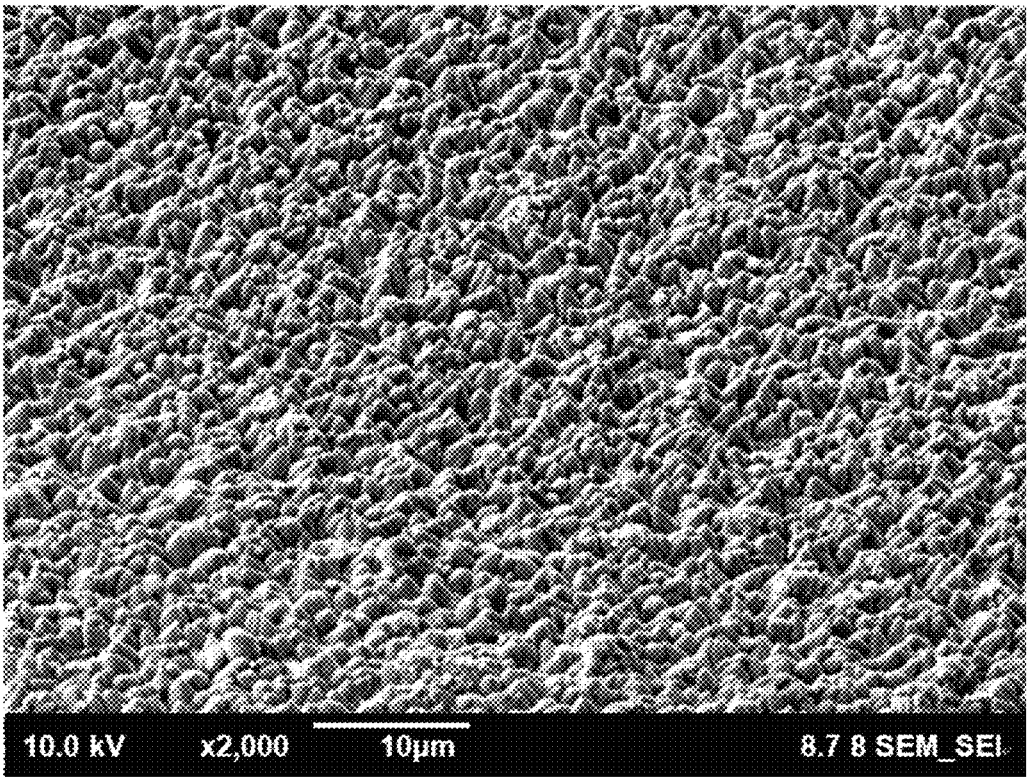
FIG. 4A shows the SEM image (2000×) of the rough surface on the matte side of the raw copper foil.
Figure 4B:
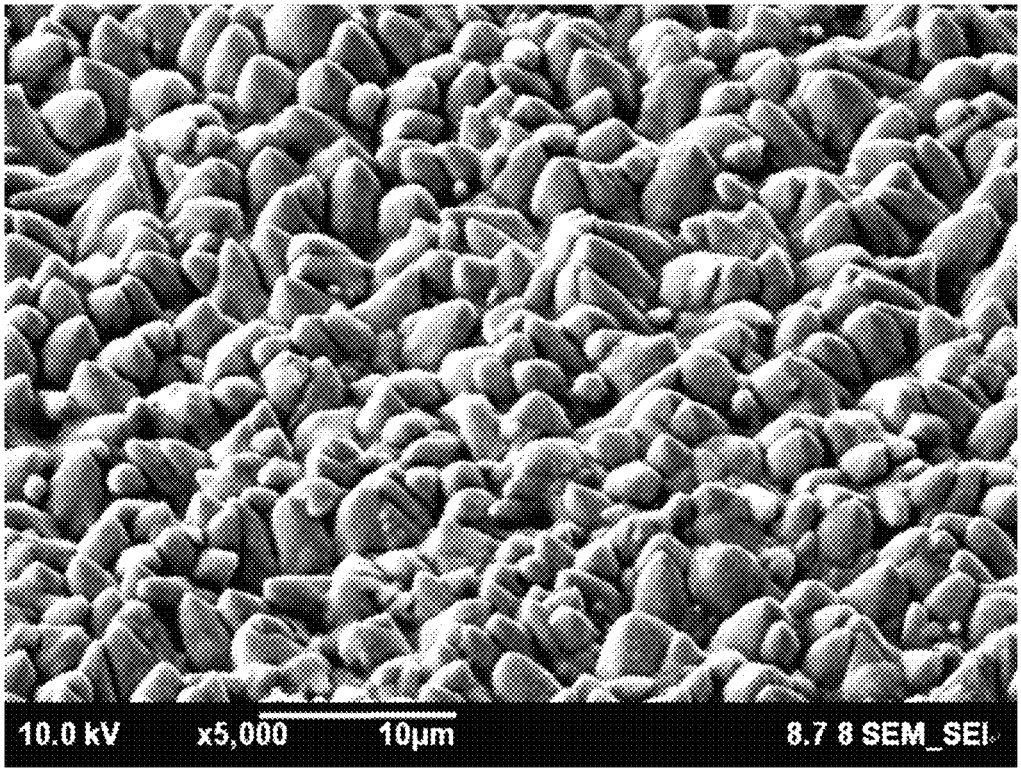
FIG. 4B shows the SEM image (5000×) of the rough surface on the matte side of the raw copper foil.

FIG. 4A and FIG. 4B show the SEM images (respectively at 2000× and 5000×) of the rough surface on the matte side of the raw copper foil. The copper nodules in the form of eggs are densely distributed on the surface. A ten-point mean roughness (Rz) of 1.0 μm-3.0 μm is measured.

Figure 4C:
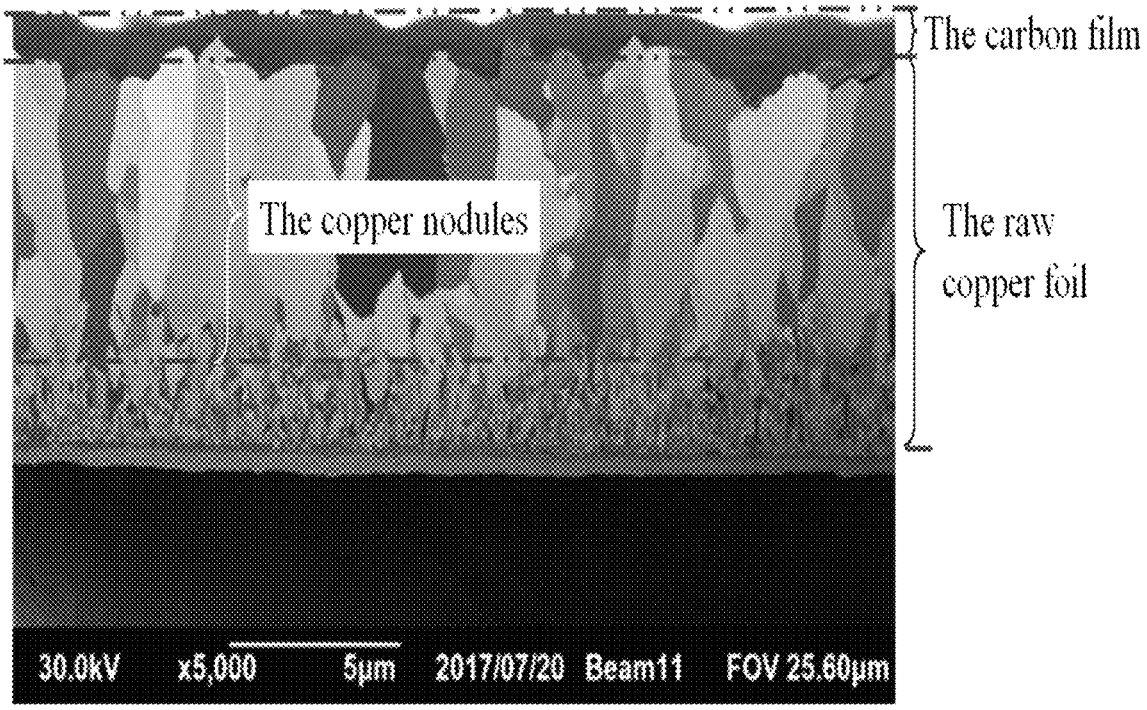
FIG. 4C shows the FIB image (5000×) of the egg-like copper nodules of Example 2.

FIG. 4C shows the FIB image (5000×) of the egg-like copper nodules, which can verify that these nodules have the structure of single crystals.

Example 3

The electrolyte solution includes chloride ions (60 ppm-80 ppm), polyethylene glycol (PEG) having a molecular weight of 4000-8000 (100 ppm-700 ppm), sulfuric acid (20 g/L-200 g/L), copper sulfate pentahydrate (70 g/L-250 g/L) and a sulfur compound (40 ppm-60 ppm).

Figure 5A:
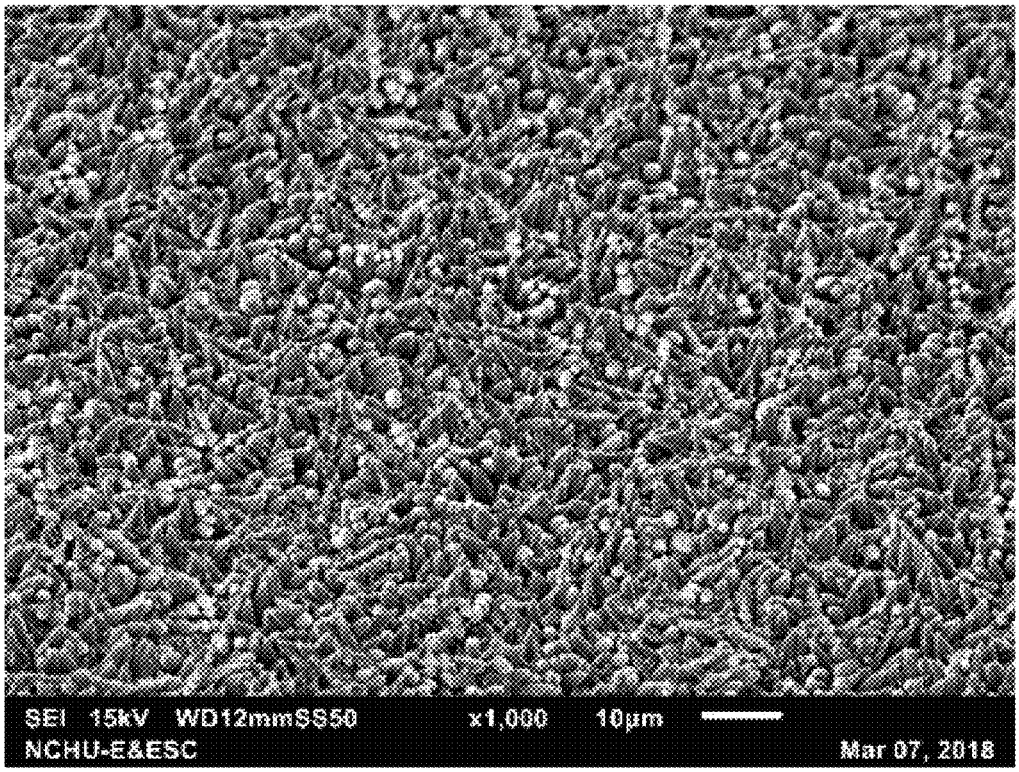
FIG. 5A shows the SEM image (1000×) of the rough surface on the matte side of the raw copper foil.
Figure 5B:
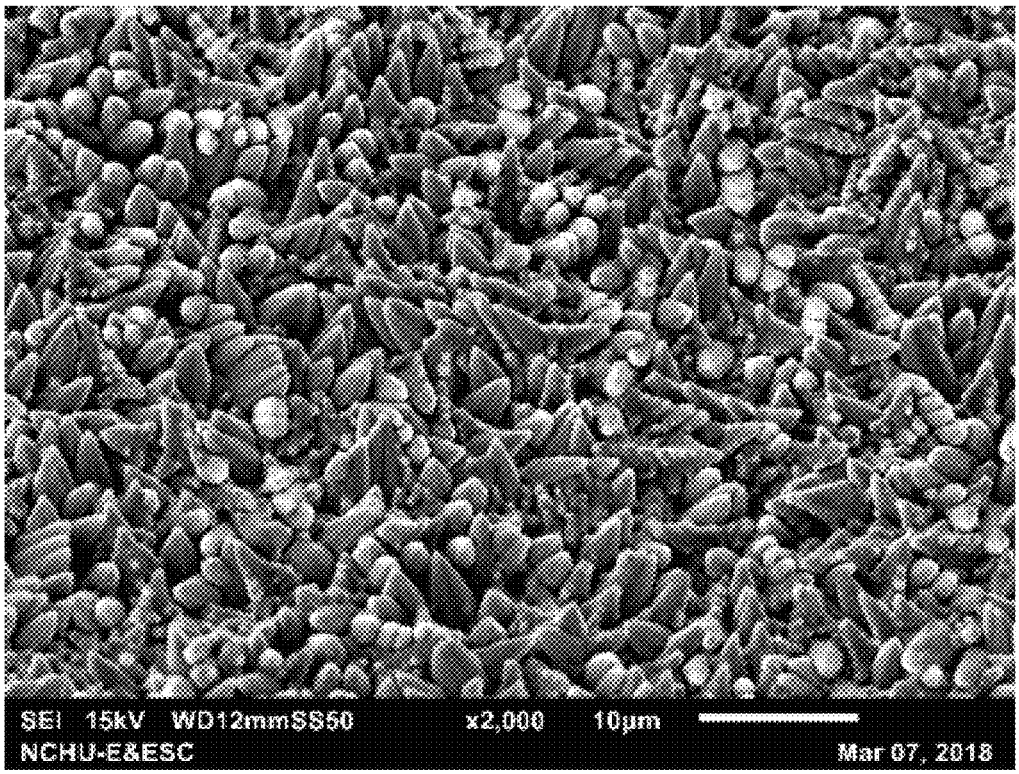
FIG. 5B shows the SEM image (2000×) of the rough surface on the matte side of the raw copper foil.

FIG. 5A and FIG. 5B show the SEM images (respectively at 1000× and 2000×) of the rough surface on the matte side of the raw copper foil. The copper nodules in the form of grains are densely distributed on the surface. A ten-point mean roughness (Rz) of 0.6 μm-4.0 μm is measured.

Figure 5C:
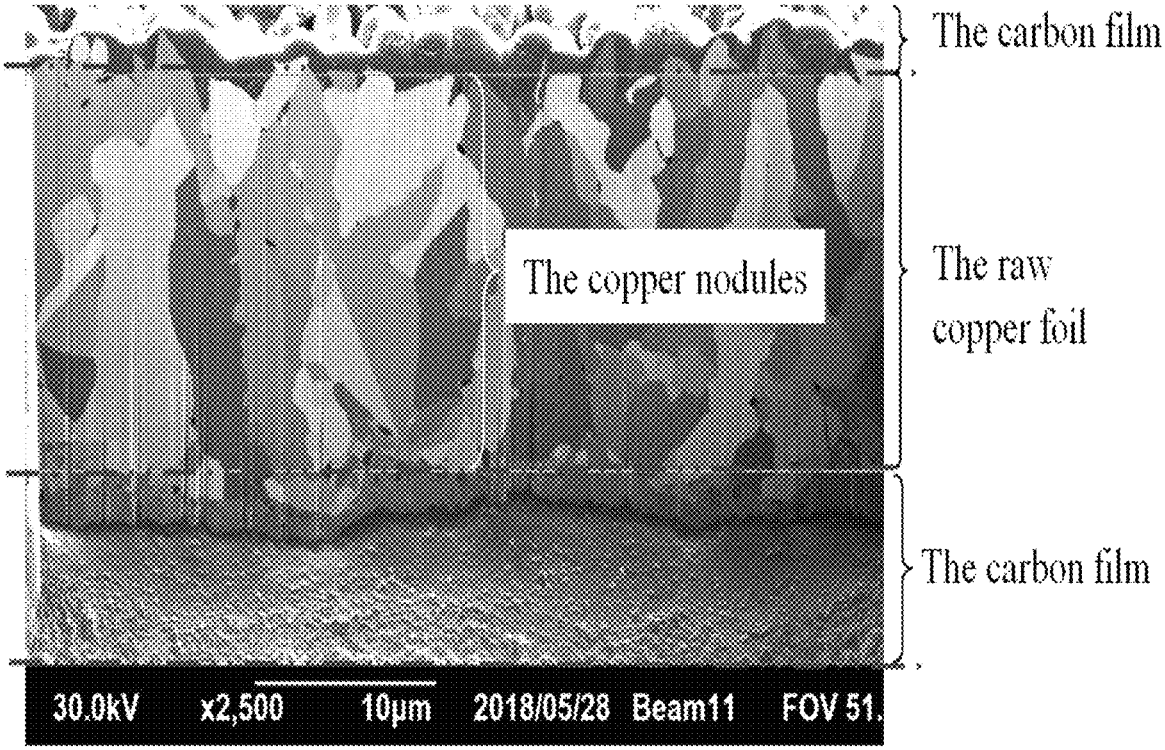
FIG. 5C shows the FIB image (2500×) of the grain-like copper nodules of Example 3.

FIG. 5C shows the FIB image (2500×) of the grain-like copper nodules, which can verify that these nodules have the structure of single crystals.

Example 4

The electrolyte solution includes chloride ions (40 ppm-80 ppm), polyethylene glycol (PEG) having a molecular weight of 1000-2500 (50 ppm-300 ppm), sulfuric acid (100 g/L-200 g/L), copper sulfate pentahydrate (120 g/L-220 g/L) and a sulfur compound (40 ppm-60 ppm).

Figure 6A:
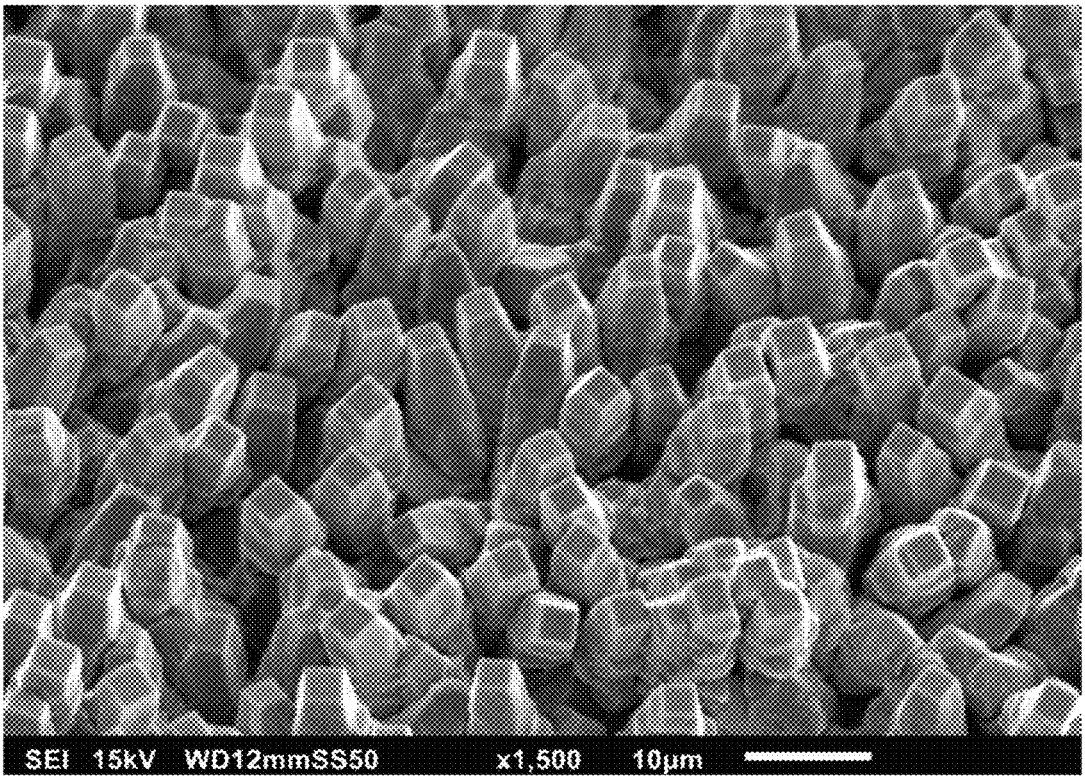
FIG. 6A shows the SEM image of top view of the rough surface on the matte side of the raw copper foil and FIG. 6B shows the SEM image of FIG. 6A after FIB process.
Figure 6B:
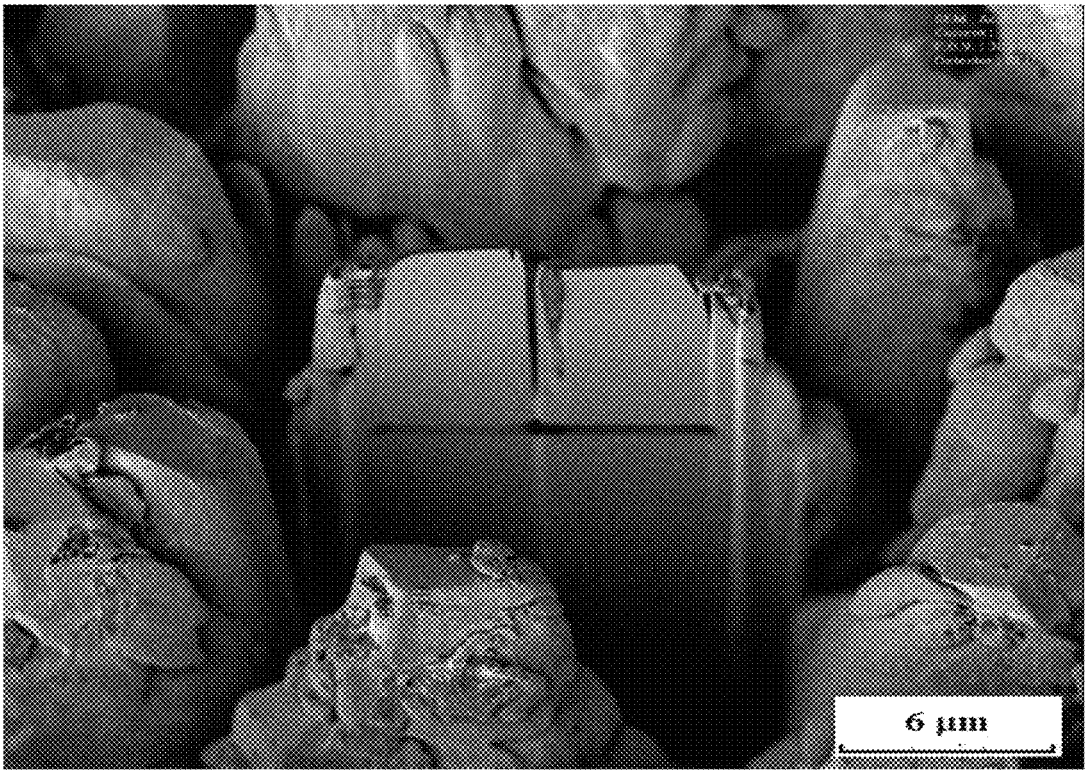

FIG. 6A shows the SEM image of top view of the rough surface on the matte side of the raw copper foil and FIG. 6B shows the SEM image of FIG. 6A after FIB process. It is observable that the shape of the copper nodule is vertical toward the substrate and has an interesting cubic stacking geometrics. The copper nodules in the form of grains are densely distributed on the surface. A ten-point mean roughness (Rz) of 7.0 μm-10.0 μm is measured.

Figure 6C:
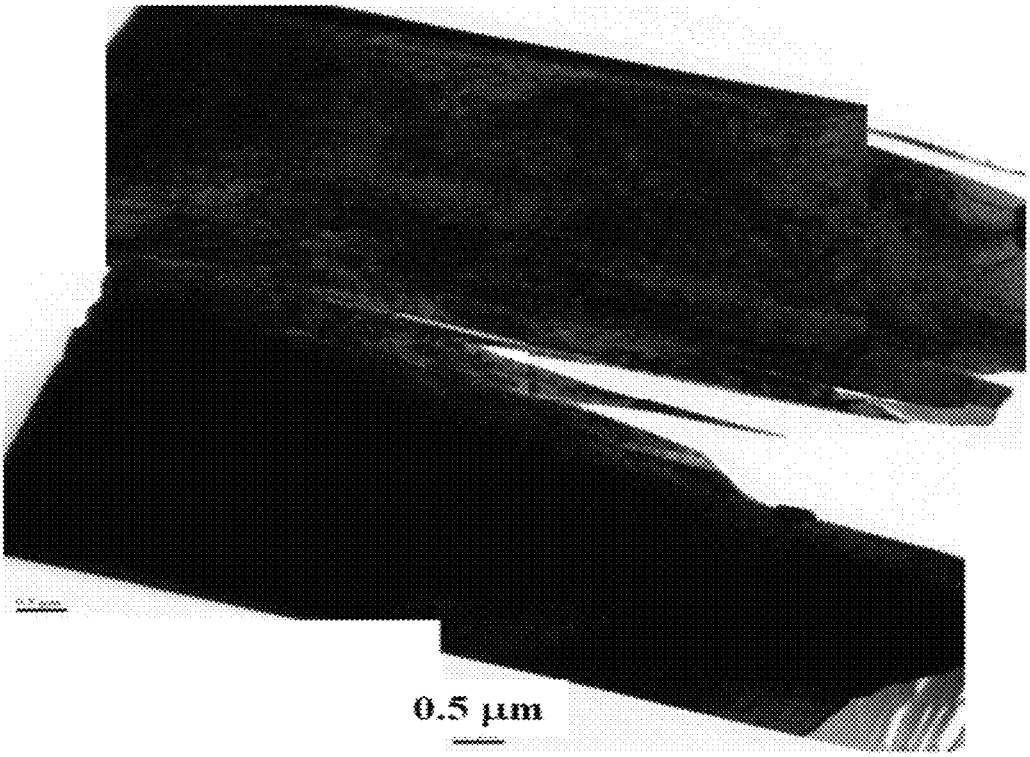
FIG. 6C and FIG. 6D show the TEM image and electron diffraction analysis, respectively, of the mansion-like copper nodules of Example 4.
Figure 6D:
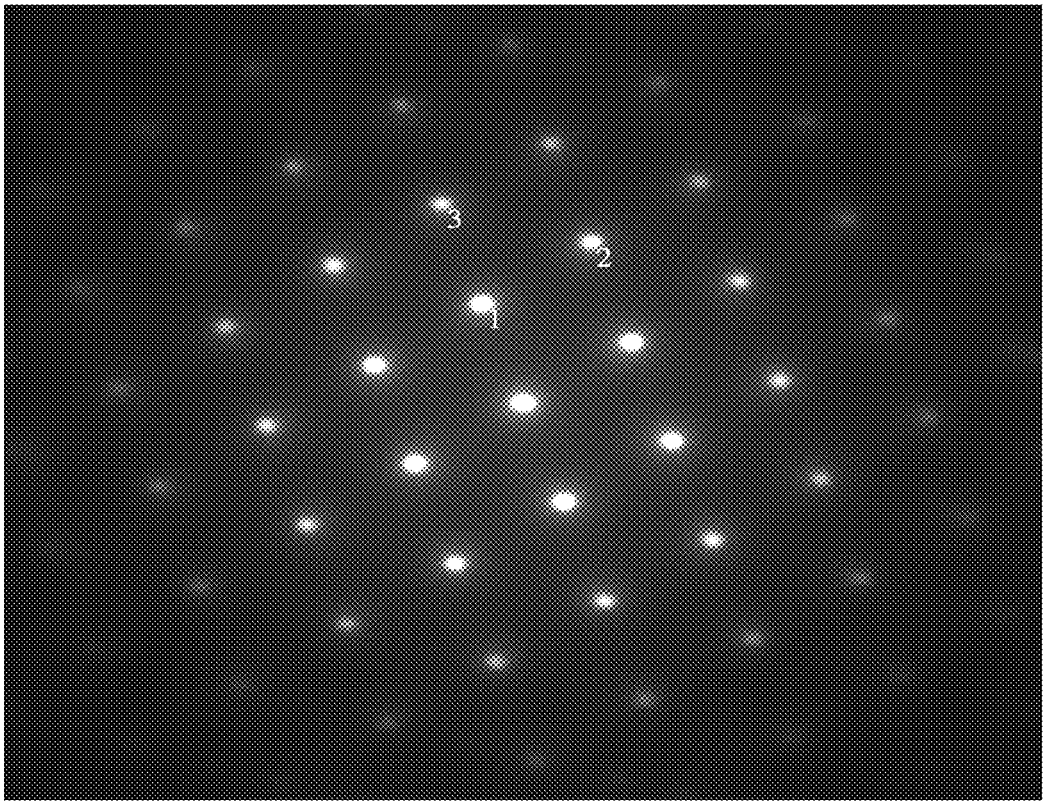

FIG. 6C and FIG. 6D show the TEM image and electron diffraction analysis, respectively, of the mansion-like copper nodules, which can verify that these nodules have the structure of single crystals.

Example 5

The electrolyte solution includes chloride ions (40 ppm-80 ppm), polyethylene glycol (PEG) having a molecular weight of 1000-3000 (100 ppm-300 ppm), sulfuric acid (200 g/L-300 g/L), copper sulfate pentahydrate (100 g/L-200 g/L) and a sulfur compound (5 ppm-30 ppm).

Figure 7A:
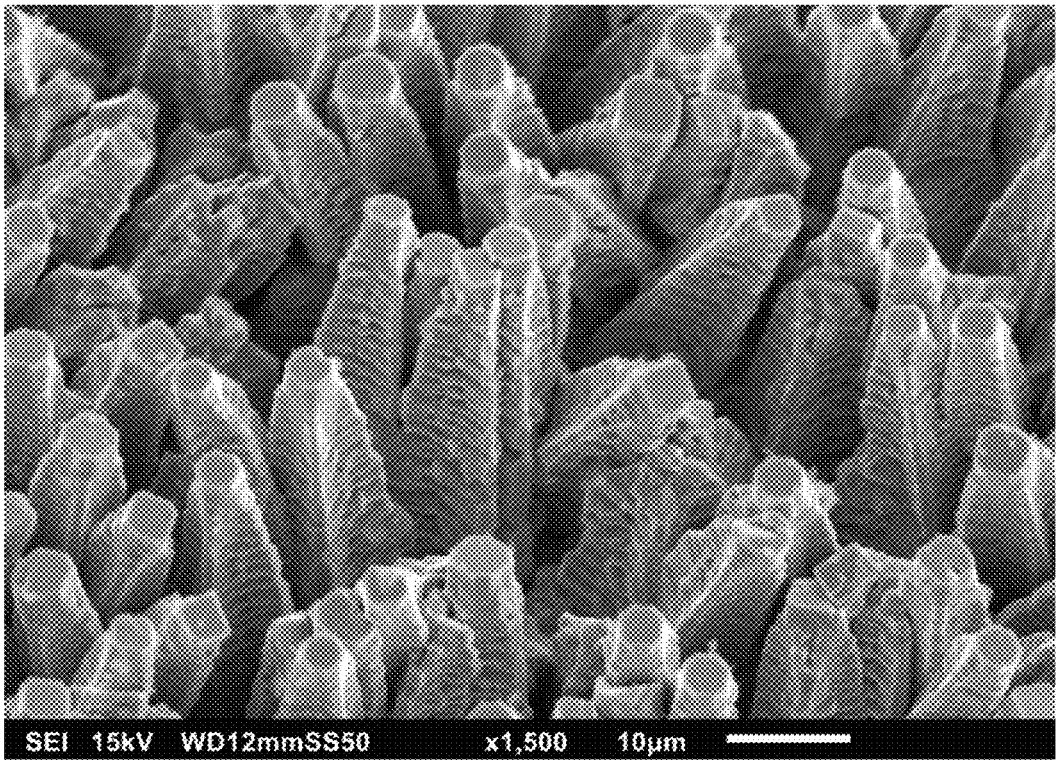
FIG. 7A shows the SEM image of top view of the rough surface on the matte side of the raw copper foil and FIG. 7B shows the SEM image of FIG. 7A after FIB process.
Figure 7B:
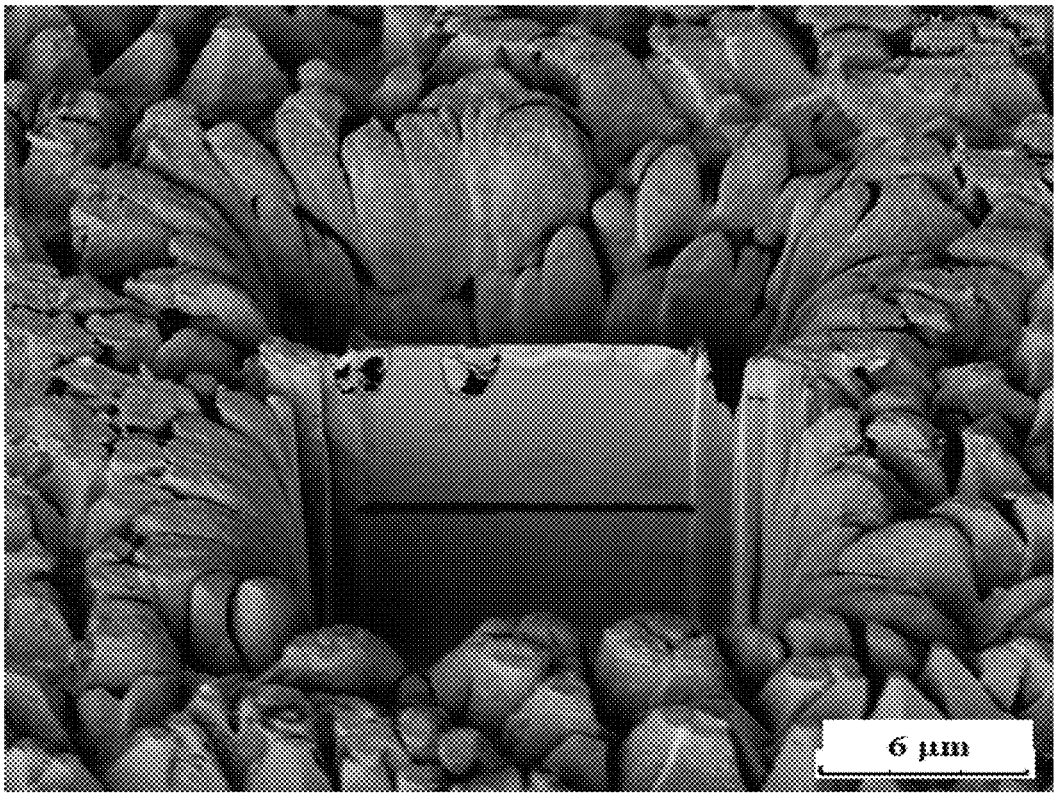

FIG. 7A shows the SEM image of top view of the rough surface on the matte side of the raw copper foil and FIG. 7B shows the SEM image of FIG. 7A after FIB process. FIG. 7A and FIG. 7B show the SEM images of the rough surface on the matte side of the raw copper foil. It is observable that the shape of the copper nodule is vertical toward the substrate and has an interesting tower geometrics. The copper nodules in the form of grains are densely distributed on the surface. A ten-point mean roughness (Rz) of 10.0 μm-20.0 μm is measured.

Figure 7C:
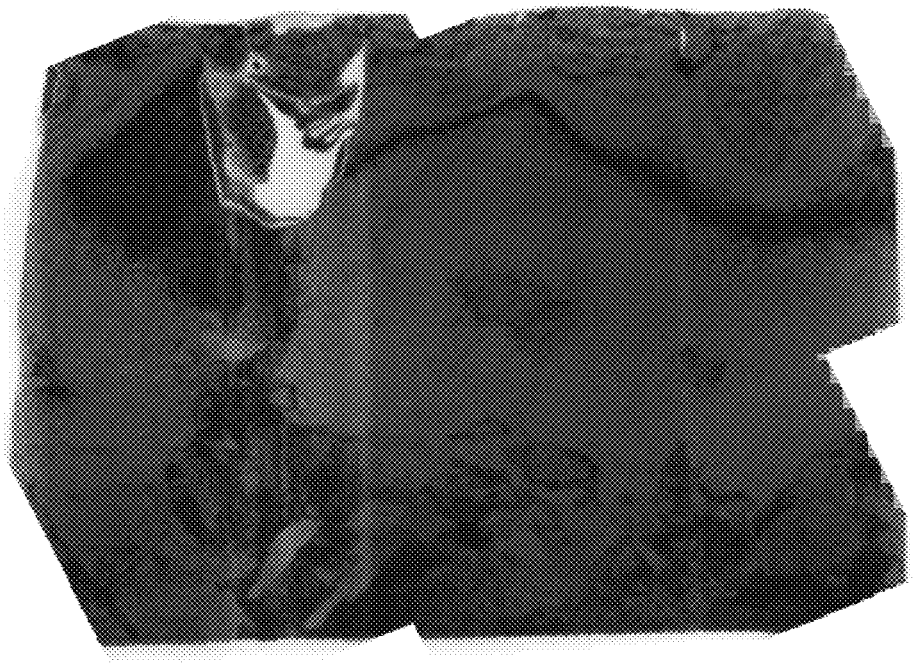
FIG. 7C and FIG. 7D show the TEM image and electron diffraction analysis, respectively, of the Eiffel Tower-like copper nodules of Example 5.
Figure 7D:
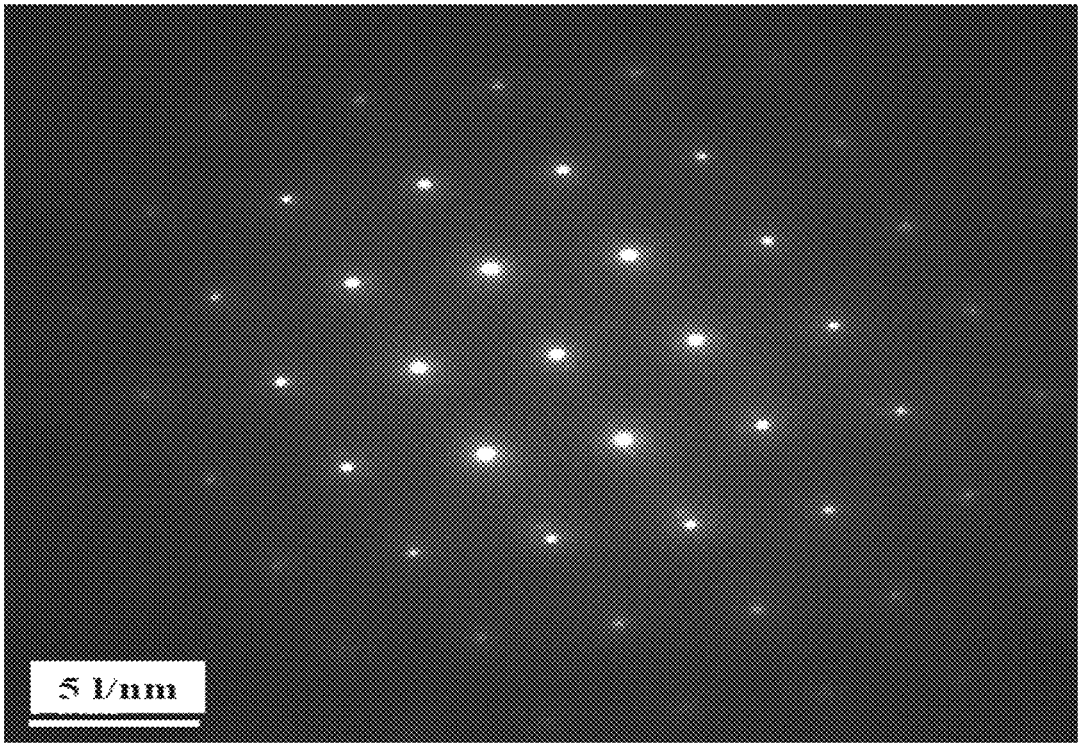

FIG. 7C and FIG. 7D show the TEM image and electron diffraction analysis, respectively, of the Eiffel Tower-like copper nodules, which can verify that these nodules have the structure of single crystals.

Summarily, the electro-deposition process is improved as the rough surface of the copper foil can be achieved simultaneously in one plating tank. The rough surface includes uniform and dense nodules of single copper crystals having specific outlooks. Compared with the traditional methods, this invention is more efficient and therefore saves a lot of cost. The single copper crystals with the rough surface have lower electric resistance than the roughed matte sides formed by the traditional methods and can be controlled in shapes and sizes by changing the components of the electrolyte solution.

The invention claimed is:

1. A copper foil, being an electro-deposited copper foil with a rough surface; wherein the rough surface comprises dense nodules of single copper crystals and has an arithmetic mean roughness (Ra) of 0.20 μm-1.5 μm and a ten-point mean roughness (Rz) of 0.5 μm-8.0 μm, wherein the nodules of single copper crystals are integrally formed with the copper foil and in the form of specific shapes.

2. The copper foil of claim 1, wherein the copper foil excluding the nodules of single copper crystals has a thickness of 2.5 μm-5.0 μm.

3. The copper foil of claim 1, wherein the nodules of single copper crystals are in the form of stepped cones, eggs or grains.

* * * * *